US005704833A

United States Patent [19]

Reix et al.

[11] Patent Number: 5,704,833

[45] Date of Patent: Jan. 6, 1998

[54] CLEAN ROOM

[75] Inventors: Jean-Michel Reix; Georges Cina; Jean-Pierre Philipoussi, all of Mandelieu, France

[73] Assignee: Aerospatiale Societe Nationale Industrielle, Paris, France

[21] Appl. No.: 791,328

[22] Filed: Jan. 31, 1997

[30] Foreign Application Priority Data

Jan. 31, 1996 [FR] France ..... 96 01120

[51] Int. Cl.[6] ..... B01L 1/04

[52] U.S. Cl. ..... 454/187; 454/57

[58] Field of Search ..... 454/187, 57

[56] References Cited

U.S. PATENT DOCUMENTS

| | | | |
|---|---|---|---|
| 5,058,491 | 10/1991 | Wiemer et al. | 454/187 |
| 5,259,812 | 11/1993 | Kleinsek . | |
| 5,350,336 | 9/1994 | Chen et al. . | |

FOREIGN PATENT DOCUMENTS

| | | | |
|---|---|---|---|
| 2417372 | 9/1979 | France . | |
| 63-99434 | 4/1988 | Japan | 454/187 |
| 2147409 | 5/1985 | United Kingdom . | |

*Primary Examiner*—Harold Joyce
*Assistant Examiner*—Derek S. Boles
*Attorney, Agent, or Firm*—Fisher, Christen & Sabol

[57] ABSTRACT

The present invention concerns a clean room featuring a closed enclosure having at least two opposite walls, a first of said walls being provided with blower means adapted to blow into said room a gaseous fluid, in particular air, having a specified controlled particle concentration, and a second wall being provided with evacuation means adapted to evacuate the gaseous fluid blown into said room. In accordance with the invention, said first wall is divided into at least two blower sectors, the blower means of each of said blower sectors blowing a gaseous fluid that has a uniform particle concentration different from the particle concentration of the other blower sector.

8 Claims, 1 Drawing Sheet

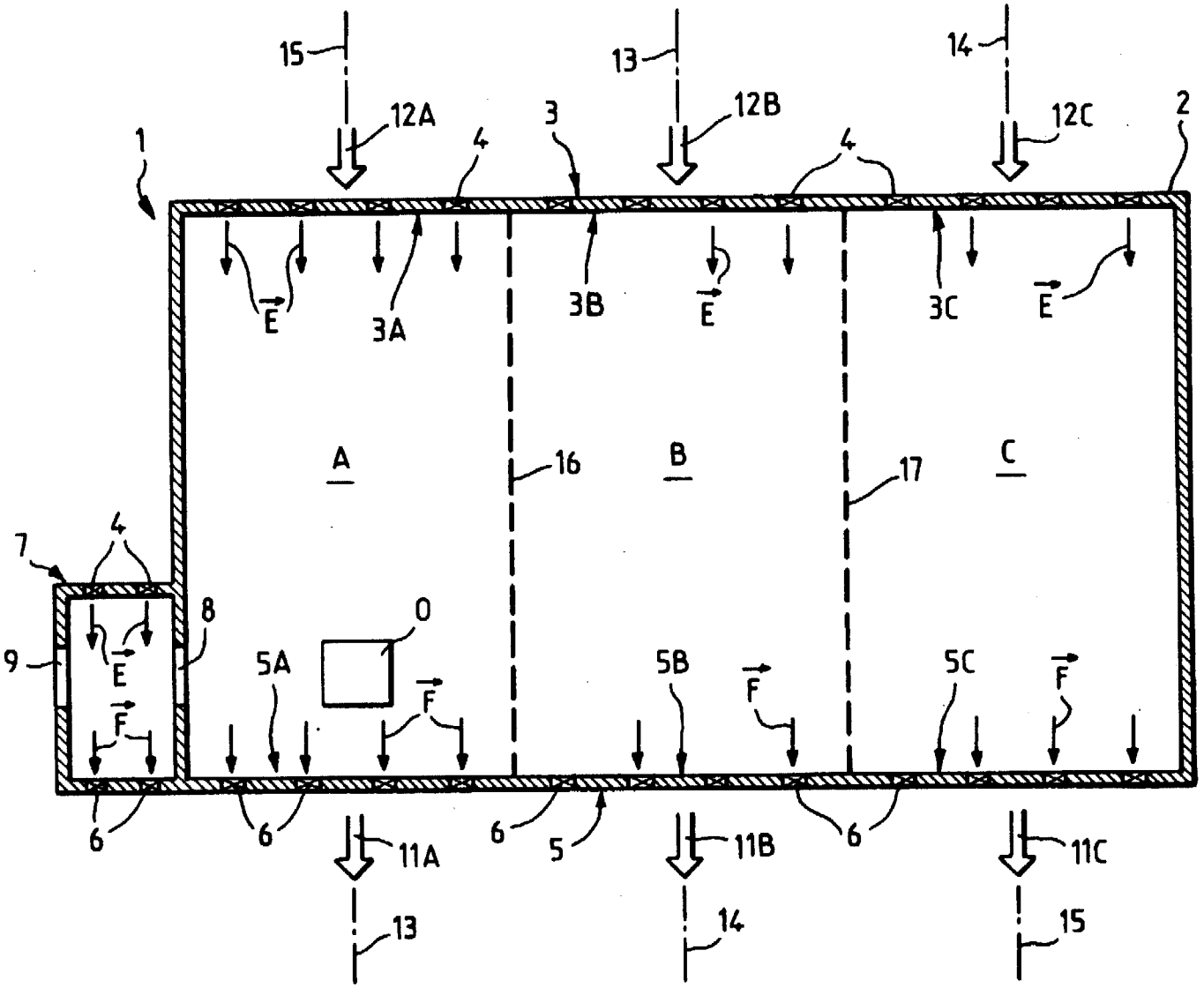
1
2
3
3A
3B
3C
4
5
5A
5B
5C
6
7
8
9
11A
11B
11C
12A
12B
12C
13
14
15
16
17
A
B
C
E
F
O

CLEAN ROOM

BACKGROUND OF THE INVENTION

1. Field of the Invention

The present invention concerns a controlled particle concentration room, also called a clean room, that is to say a room in which particulate pollution of the gaseous fluid, for example air, introduced into it is controlled.

In the context of the present invention, the particle concentration of a gaseous fluid is defined by the numerical concentrations of particles in suspension the sizes of which are greater than specified particle size levels. The particle concentration of an enclosure is generally characterized by clearly delimited particle concentration classes. In a manner that is known in itself, the limit of a particle concentration class of this kind is determined by fixing a maximal numerical concentration for all possible particle size levels in order of increasing dimensions, as explained in more detail below.

2. Description of the Prior Art

In a manner that is known in itself, a clean room, which may be used to test objects, in particular objects to be used in space, such as satellites, for example, in a controlled environment, usually features a closed enclosure having at least two opposite walls, the first of said walls being provided with blower means adapted to blow into said room a gaseous fluid, in particular air, having a specified controlled particle concentration, and the second wall being provided with evacuation means adapted to evacuate the gaseous fluid blown into said room.

A test site, for example one for testing satellites, generally includes a plurality of adjacent test rooms of the type described above each having a different particle concentration. The object to be tested must be brought into an environment appropriate to the type of test envisaged, in particular one having a specified particle concentration. Accordingly, during the tests, the object is generally transported into different rooms in succession, each room having the particle concentration appropriate to the type of test envisaged.

These operations of transporting the object from one room to another have many disadvantages. In particular they require long and irksome work and dedicated and costly handling means. Moreover, the risk of damage to the object is high, especially if it is fragile.

When two rooms to be used in succession are adjacent, the object is generally transported through an opening in the wall between the two rooms.

Otherwise, entry to a room is effected via an entry airlock having a specified particle concentration, in which the object is cleaned to remove the dust deposited during its transportation between the two rooms through an environment in which the particle concentration is generally neither low nor controlled. It is consequently necessary to provide an airlock at the entry of each room and to carry out such cleaning before entry into each of said rooms.

The present invention concerns a clean room of the type previously described which remedies the above disadvantages.

SUMMARY OF THE INVENTION

To this end, in accordance with the invention, in a clean room featuring a closed enclosure having at least two opposite walls, a first of said walls being provided with blower means adapted to blow into said room a gaseous fluid, in particular air, having a specified controlled particle concentration, and a second wall being provided with evacuation means adapted to evacuate the gaseous fluid blown into said room, said first wall is divided into at least two blower sectors, the blower means of each of said blower sectors blowing a gaseous fluid that has a uniform particle concentration different from the particle concentration of the other blower sector.

Accordingly, in accordance with the invention, at least two areas each having a specified and controlled particle concentration, which is different from the particle concentration of the other area, are created in the same room. In accordance with the invention, it is possible to create in said room as many areas with different particle concentrations as are needed for the operations envisaged, by dividing the first wall into an appropriate number of different blowing sectors.

Consequently, it is not necessary to transport the object many times through intermediate walls and/or entry airlocks during the tests. All the tests can be carried out in one and the same room, namely in the clean room according to the invention.

Moreover, it is only necessary to provide a single entry airlock and to carry out a single operation of cleaning the object before it enters said clean room.

In a first embodiment of the invention, said opposite walls correspond to two opposite walls of said clean room, whereas in a second embodiment, said first wall represents the ceiling and said second wall represents the floor of the clean room.

Moreover, if the second wall is divided into evacuation sectors that are opposite respective blower sectors of the first wall and which each evacuate the gaseous fluid from the opposite blower sector, the room is advantageously such that the gaseous fluid evacuated by each of said evacuation sectors is recycled to the non-opposite blower sector, so enabling the use of a gaseous fluid that already has a low particle concentration and that can easily be treated to obtain the required particle concentration, in particular by filtering it, preferably by means of activated carbon filters disposed at the entry of the gaseous fluid into the blower means (of said first wall).

In this case, the gaseous fluid to be evacuated is advantageously channeled in the second wall and is directed towards the first wall by means of networks of feed connections.

Moreover, said clean room may advantageously include a removable opaque curtain adapted to be deployed along the line of separation between the areas created in accordance with the invention so as to prevent the passage of light from one area to the other, which makes it possible to darken one of the areas if the latter does not include any light source. This solution may be used when tests have to be carried out in darkness.

The walls of the room in accordance with the invention are advantageously plane and uniform to reduce the possibility of retention of dust and they are covered with a material that is easy to clean, for example an appropriate white paint. This provides an effective way of preventing any increase in the particle concentration of the room.

BRIEF DESCRIPTION OF THE DRAWING

The single FIGURE in the accompanying drawing shows how the invention may be put into effect. The FIGURE is a diagrammatic representation of a clean room in accordance with the invention.

DETAILED DESCRIPTION OF THE PREFERRED EMBODIMENT

The clean room 1 in accordance with the invention and shown diagrammatically in the FIGURE is more particularly, although not exclusively, adapted to be used as a test room for an object 0 shown diagrammatically, in particular an object to be used in space, such as a satellite.

To this end, said room 1 must have a specified particle concentration, i.e. a particular concentration of particles in suspension. Said particle concentration is characterized by particle concentration classes denoted "y classes" (y being a variable integer). In a manner that is known in itself, said particle concentration classes are limited by a maximal number of particles having dimensions greater than predefined dimensions for a particular volume.

For example:

class 1 allows at most:

only one particle with dimensions greater than or equal to 0.5 μm per cubic foot (or 35 particles per $m^3$);

three particles with dimensions greater than or equal to 0.3 μm per cubic foot; and 35 particles with dimensions greater than or equal to 0.1 μm per cubic foot;

class 100 allows at most 100 particles having dimensions greater than or equal to 0.5 μm per cubic foot; and class 10,000 allows at most 10 000 particles having dimensions greater than or equal to 0.5 μm per cubic foot.

In a manner that is known in itself, to enable the particle concentration to be controlled, the room 1 is in the form of a closed and sealed enclosure 2:

a wall 3 of which, corresponding to a wall of the room 1, is provided with blower means 4, of a type known in itself, shown diagrammatically. Said blower means 4 are uniformly distributed over said wall 3 in the heightwise and widthwise directions and are adapted to blow into said enclosure 2 a gaseous fluid, for example air, having a specified particle concentration, as shown by the arrows $\vec{E}$; and a wall 5 of which opposite the wall 3 is provided with evacuation means 6 of a type known in itself, shown diagrammatically, also uniformly distributed and adapted to evacuate the gaseous fluid blown into the enclosure 2, as shown by the arrows $\vec{F}$.

The room 1 also includes an entry airlock 7 near an entry door 8 of the enclosure 2.

The entry airlock 7 has a door 9 opening to the exterior and is adapted to enable the object O (and possibly personnel and equipment) to be cleaned before entering the enclosure 2. To this end, the particle concentration in the entry airlock 7 is made identical to that in the enclosure 2, using blower means 4 and evacuation means 6. The object O or any other equipment is generally cleaned in the airlock using a vacuum cleaner and/or special products, for example isopropyl alcohol or freon.

Because the various tests carried out during a series of tests must generally be carried out in different environments and therefore with different particle concentrations, it is necessary to transport said object O into different rooms in succession, each room having the required particle concentration.

Meeting this obligation during the conduct of the tests has many disadvantages, including:

the transportation of the object O is time consuming and irksome, especially if the object is fragile;

said transportation requires costly dedicated handling means; and the object O must be cleaned each time it enters a new room.

The room 1 of the invention is designed to eliminate these disadvantages.

In accordance with the invention, to achieve this objective, the wall 3 of the room 1 is divided into a plurality of blower sectors 3A, 3B and 3C and the blower means 4 of each of said sectors 3A, 3B, 3C blow a gaseous fluid having a uniform particle concentration that is different from the particle concentration of the other blower sectors, so as to create in the room 1 areas A, B and C having specified particle concentrations.

In each of said areas A, B and C there is created between the blower means 4 and the evacuation means 6 a laminar flow of the gaseous fluid, with straight and parallel flow lines (illustrated by the arrows $\vec{E}$ and $\vec{F}$ and with little mixing of said flow lines, which produces clearly delimited areas A, B and C in each of which the particle concentration is uniform.

The particle concentration in each of said areas A, B and C is controlled by controlling the particle concentration of the gaseous fluid blown from the blower sectors 3A, 3B and 3C, respectively.

In this way it is possible to provide as many different areas as are needed for the various tests envisaged so that all the tests can be carried out in the room 1 of the invention, which eliminates the disadvantages previously referred to. In accordance with the invention, it is sufficient to move the object O each time into the appropriate area by means of an appropriate handling device, for example a traveling overhead crane.

Moreover, the wall 5 is also divided into evacuation sectors 5A, 5B and 5C respectively opposite the blower sectors 3A, 3B and 3C.

Note that, in the context of the present invention, the blower means 4 may be provided in the ceiling of the room 1, which is not shown, with the evacuation means 6 in the floor of said room 1.

The gaseous fluid to be evacuated via the wall 5 is channeled in the various evacuation sectors 5A, 5B and 5C, as indicated by the respective arrows 11A, 11B and 11C before it is evacuated.

In accordance with the invention, the gaseous fluid channeled in this way is recycled by the blower means 4 of the various blower sectors 3A, 3B and 3C of the wall 3, as indicated by arrows 12A, 12B and 12C, in a particular order.

To be more precise:

the gaseous fluid taken in from the sector 5A is transmitted via a network of feed connections, indicated by a chain-dotted line 13, to the blower sector 3B;

the gaseous fluid taken in from the sector 5B is transmitted via a network of feed connections 14 to the blower sector 3C; and the gaseous fluid taken in from the sector 5C is transmitted via a network of feed connections 15 to the blower sector 3A.

In accordance with the invention, there may be additionally provided along the lines of separation 16 and 17 between the areas A and B and the areas B and C, respectively, a removable opaque curtain, not shown, adapted to prevent the passage of light so that darkness can be produced in at least one of said areas A, B and C, for example if it is necessary to carry out tests in darkness.

It will be noted that, in one particular embodiment of the invention 1, not shown, the airlock 7 can be used for all bulky equipment and an additional airlock may be provided for personnel and less bulky equipment. Airlocks, not shown, may also be provided in the wall 5, for example, between the areas A and B and the areas B and C, to enable personnel to clean and/or clothe themselves appropriately before entering an area in which the particle concentration is lower than in the previous area.

There is claimed:

1. A clean room featuring a closed enclosure having at least two opposite walls, a first of said walls being provided with blower means adapted to blow into said room a gaseous fluid, in particular air, having a specified controlled particle concentration, and a second wall being provided with evacuation means adapted to evacuate the gaseous fluid blown into said room, wherein:

said first wall is divided into at least two blower sectors, the blower means of each of said blower sectors blowing a gaseous fluid that has a uniform particle concentration different from the particle concentration of the other blower sector; and said second wall is divided into evacuation sectors that are opposite respective blower sectors of said first wall and each of which evacuates the gaseous fluid from said opposite blower sector.

2. The clean room claimed in claim 1 wherein said opposite walls are two opposite walls of said clean room.

3. The clean room claimed in claim 1 wherein said first wall is the ceiling and said second wall is the floor of said clean room.

4. The clean room claimed in claim 1 wherein said gaseous fluid evacuated by each of said evacuation sectors is recycled to the non-opposite blower sector.

5. The clean room claimed in claim 4 wherein said gaseous fluid to be evacuated is channeled in said second wall and is directed towards said first wall by means of networks of feed connections.

6. A clean room as claimed in claim 1 further including activated carbon filters disposed where said gaseous fluid enters said blower means.

7. A clean room as claimed in claim 1 having at least two different particle concentration areas and including a removable opaque curtain adapted to be deployed along the line of separation between said areas so as to prevent the passage of light from one area to the other.

8. The clean room claimed in claim 1 wherein the walls of said clean room are plane and uniform in order to reduce the possibility of retention of particles and are coated with a material that is easy to clean.

* * * * *